US005857365A

United States Patent [19]

Armstrong

[11] Patent Number: 5,857,365

[45] Date of Patent: Jan. 12, 1999

[54] ELECTRONICALLY OPERATED LOCK

[75] Inventor: Steven Armstrong, Yorba Linda, Calif.

[73] Assignee: Emhart Inc., Newark, Del.

[21] Appl. No.: 2,821

[22] Filed: Jan. 5, 1998

Related U.S. Application Data

[63] Continuation-in-part of Ser. No. 827,968, May 2, 1997, abandoned.

[51] Int. Cl.[6] ..... E05B 47/00

[52] U.S. Cl. ..... 70/279; 70/280; 292/142; 292/144

[58] Field of Search ..... 70/275, 277, 278–283; 292/142, 144

[56] References Cited

U.S. PATENT DOCUMENTS

| | | | |
|---|---|---|---|
| 3,844,592 | 10/1974 | Giardina et al. | 292/142 X |
| 3,947,060 | 3/1976 | Zimmer et al. | 292/142 |
| 4,438,962 | 3/1984 | Soloviff et al. | 292/144 |
| 4,949,563 | 8/1990 | Gerard et al. | 292/144 X |
| 4,986,099 | 1/1991 | Johnson et al. | 292/144 X |
| 5,083,448 | 1/1992 | Kärkkäinen et al. | 292/144 X |

FOREIGN PATENT DOCUMENTS

| | | | |
|---|---|---|---|
| 2535774 | 5/1984 | France | 70/277 |
| 4189988A | 7/1992 | Japan | 70/275 |

*Primary Examiner*—Lloyd A. Gall
*Attorney, Agent, or Firm*—Spencer T. Smith

[57] ABSTRACT

An electronically operated lock has a latch mechanism which is operable by a rotatable spindle. The spindle can be rotated manually either by an inside turn lever or a key operated outside plug or rotated electronically. A pinion is secured to the spindle and a slider supported for vertical displacement has a vertical rack which cooperates with the pinion. The slider has vertically separated upper and lower control surfaces and a rotatable wheel gear has an eccentric axially extending finger located intermediate the upper and lower control surfaces. The wheel gear is driven by a single direction motor through gearing. The upper and lower control surfaces are selectively located so that when the finger is rotated in one direction from a 3:00 position to a 9:00 position, the displacement of the slider will displace the bolt to the retracted position and so that when the finger is rotated in that direction from the 9:00 position to the 3:00 position, the displacement of the slider will displace the bolt to the advanced position.

8 Claims, 8 Drawing Sheets

ELECTRONICALLY OPERATED LOCK

CROSS-REFERENCE TO RELATED APPLICATION

This is a continuation-in-part application of U.S. Ser. No. 08/827,968, filed May 2, 1997, now abandoned.

ELECTRONICALLY OPERATED LOCK

The present invention relates to door locks and more particularly to door locks which are electronically operated.

BACKGROUND OF THE INVENTION

This application is a continuation-in-part of U.S. patent application Ser. No. 08/827,968, filed May 2, 1997, now abandoned.

To secure a door, a deadbolt may be extended from the door into a suitable opening in the door jamb. The deadbolt may be separate from other locking elements or it can be interconnected with a conventional lock which is operated with a knob or lever.

Deadbolts are available which have battery powered deadbolt pulling and advancing mechanisms actuated by inputting a code into a finger operated terminal.

The cost of rolling code technology has reduced to the point where it is economically feasible to incorporate this technology into such a lock.

OBJECT OF THE INVENTION

It is accordingly an object of the present invention to provide a lock which has a bolt which can be operated by inputting a code via a transmitter or finger operated terminal.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE PREFERRED EMBODIMENT

Figure 1:
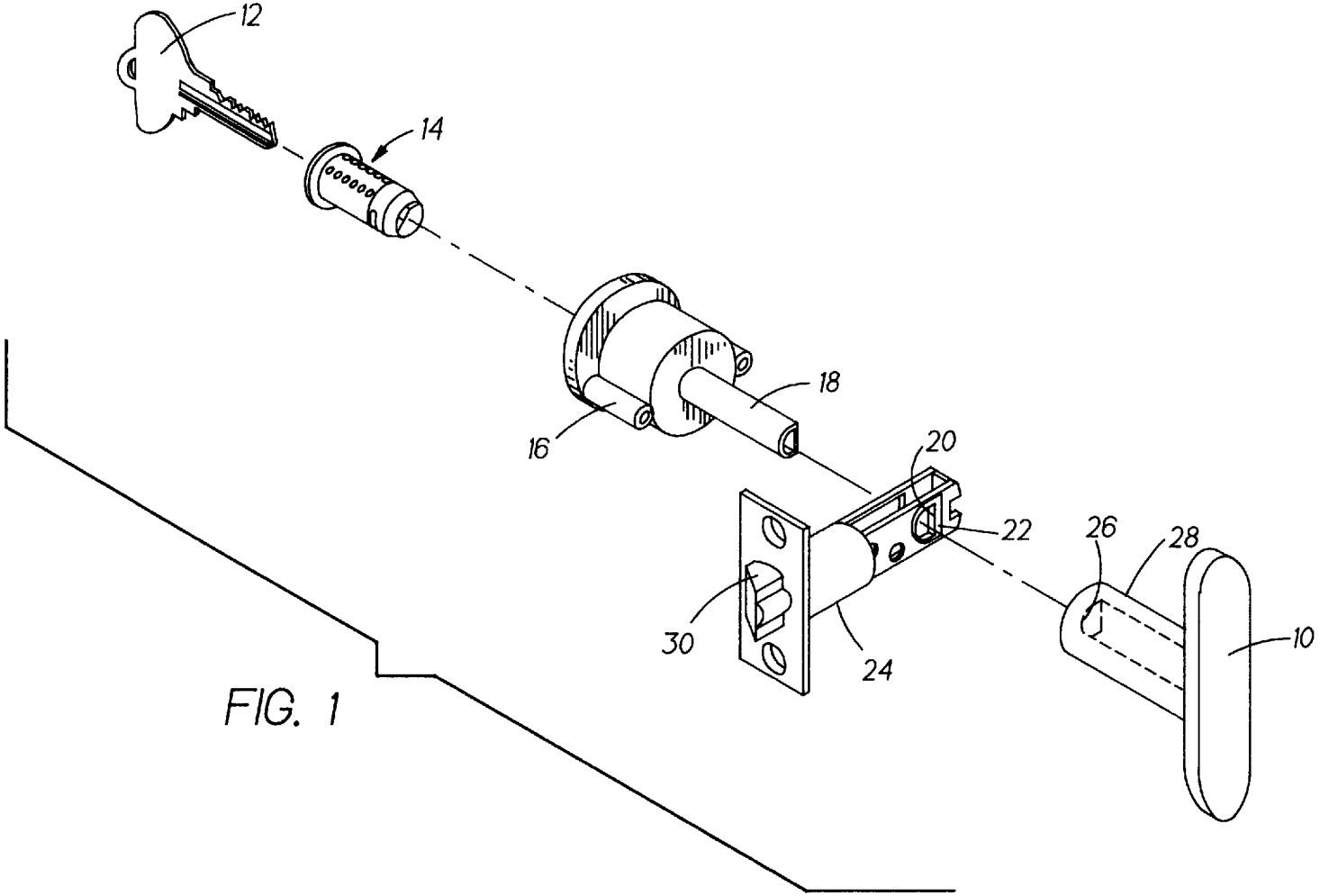
FIG. 1 is an oblique exploded view of a portion of a deadbolt made in accordance with the teachings of the present invention.

A deadbolt is conventionally operated by either turning a turn lever 10 on the inside of the door or by turning a key

12 on the outside of the door. The key is introduced into a plug 14 which is received by a suitable housing 16. Rotatably secured within the housing is a torque blade 18 which is "D" shaped in cross section and which extends through a similarly shaped opening 20 in the actuator 22 of a dead latch 24 and into a similarly shaped hole 26 in the shaft portion 28 of the interior turn lever 10. The plug is connected to the torque blade and accordingly rotation of the torque blade either by rotating the turn lever 90° or turning the key 90° will either advance (throw) or retract the bolt 30.

To electronically operate the deadlock, a run signal is supplied to the single direction D.C. 6 V motor 32. The control 33, which can be a receiver type control which receives signals from a remote transmitter and the motor are battery 34 powered. The motor has a worm output 36 which drives a worm gear 37 which has a small coaxial gear 38 (FIG. 3) which drives a wheel gear 39 (there is a 250/1 gear reduction from the wheelgear to the worm). The worm gear is rotatably mounted on a support bracket 40 which also supports the motor and the batteries and the wheel gear is rotatably mounted on a suitable bearing member 42 (FIG. 5) on the inner surface of the lower shroud 44 of the interior operator assembly.

Figure 2:
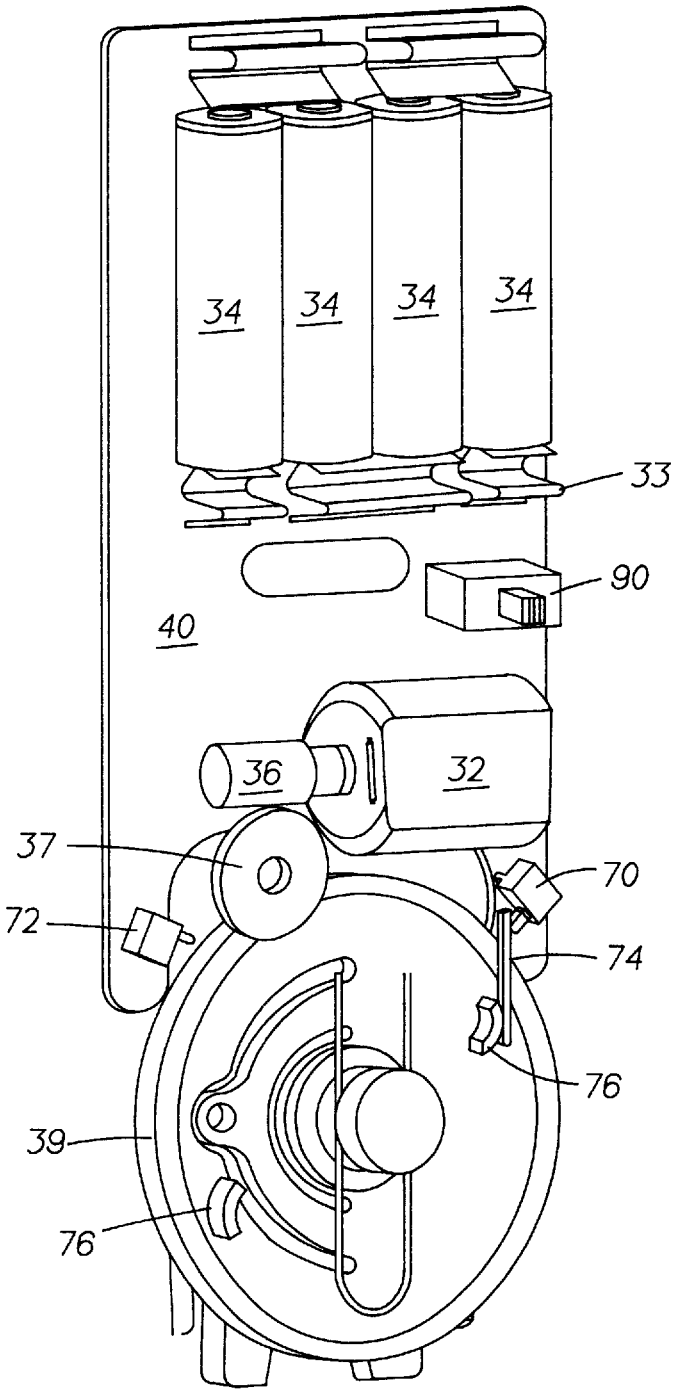
FIG. 2 is a perspective view, from the front, of the interior turn lever assembly.
Figure 3:
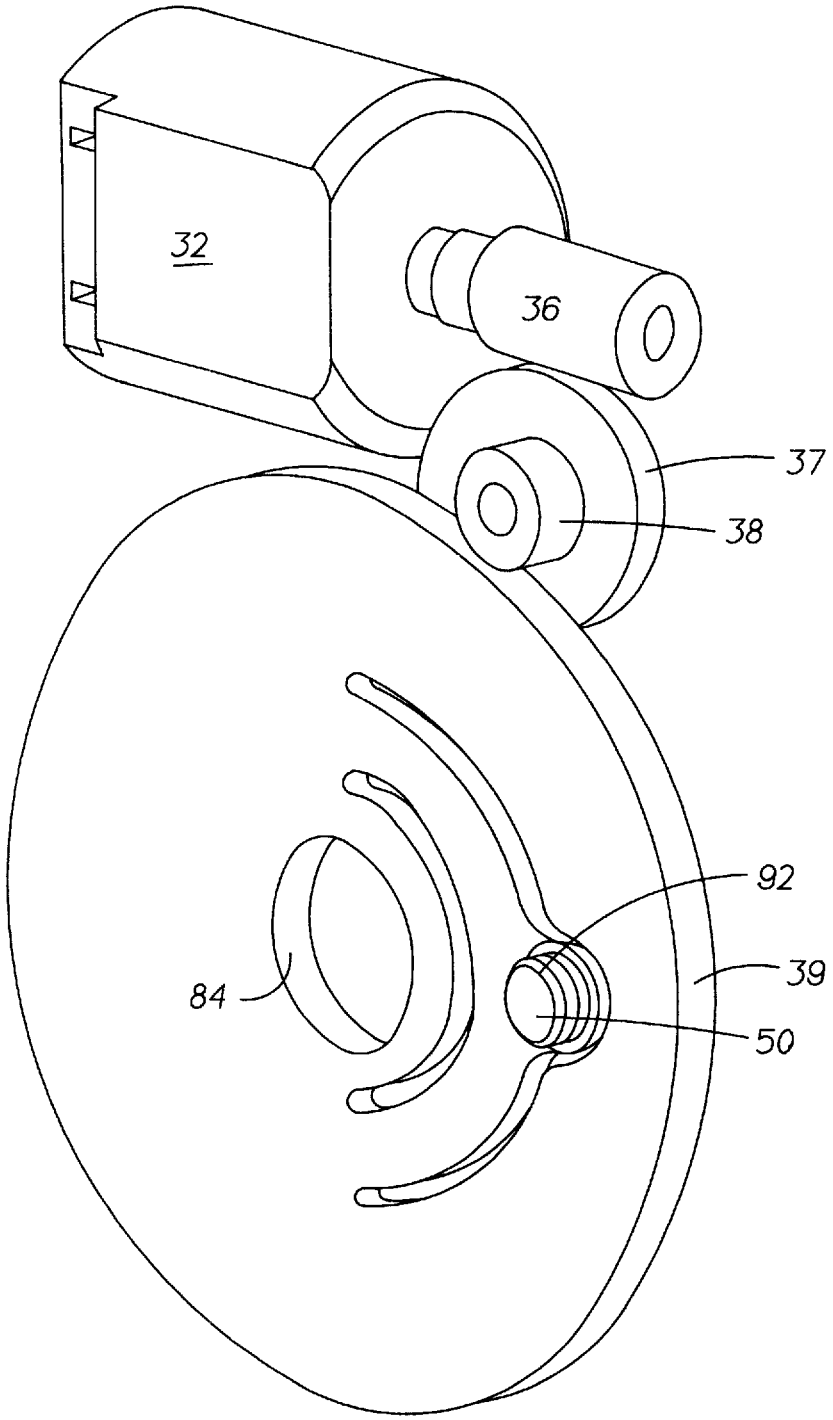
FIG. 3 is a perspective view of the motor/worm gear/wheel gear shown in FIG. 2, seen from the inside.
Figure 4:
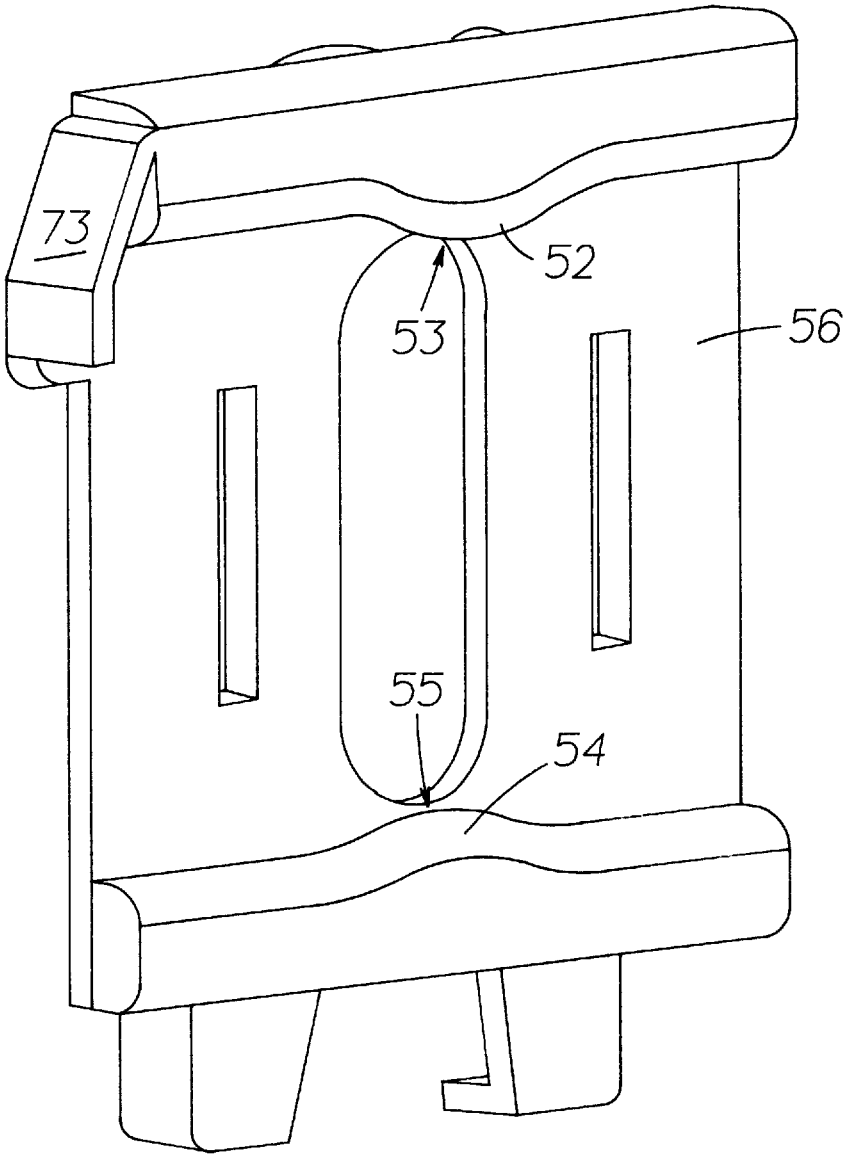
FIG. 4 is an oblique view, from the front of the rack portion of the interior turn lever assembly.
Figure 5:
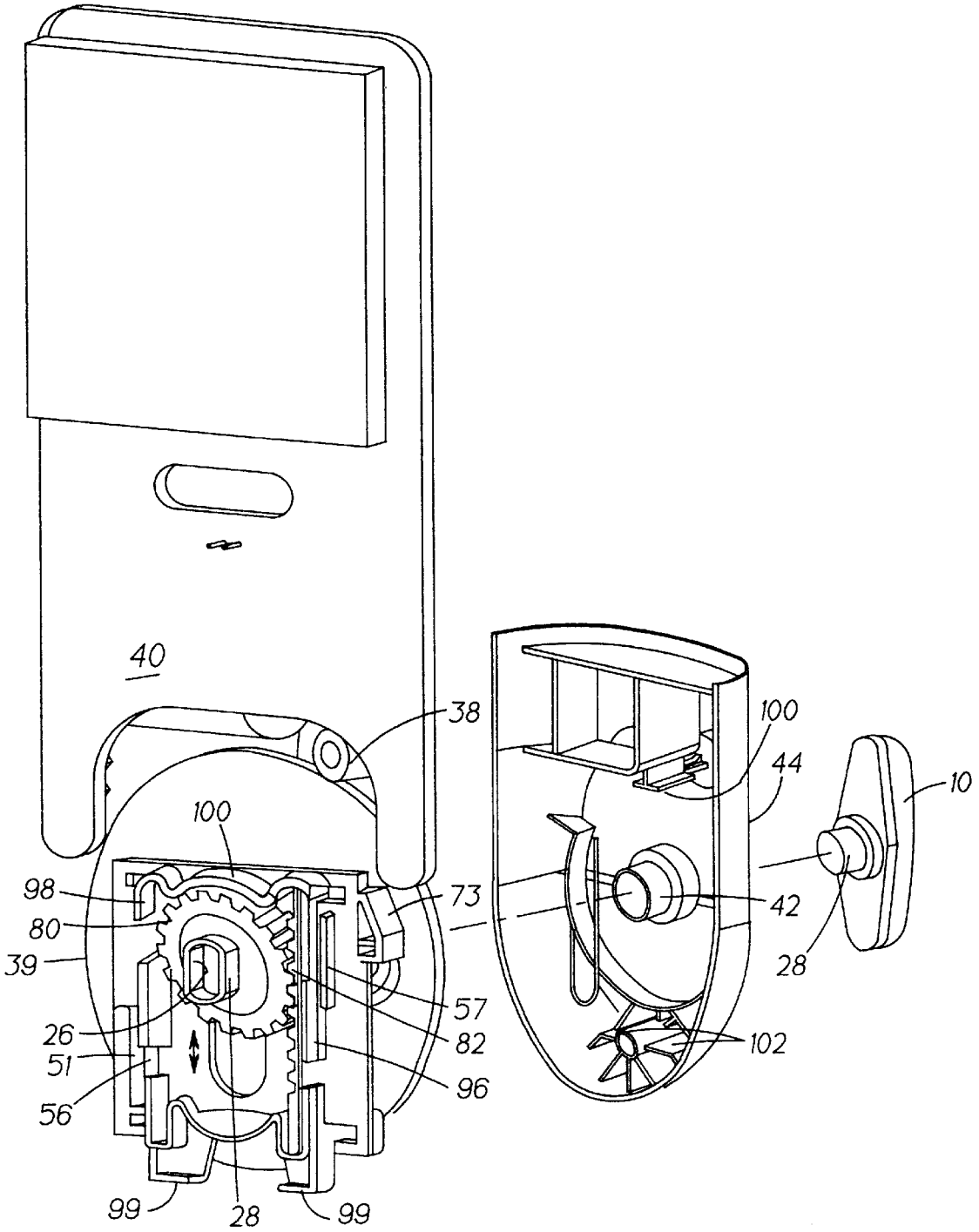
FIG. 5 is a perspective view, from the rear, of the interior turn lever assembly.

The inner (facing the door) surface of the wheel gear (FIG. 3) has an axially projecting finger 50 which is button shaped and is located between an upper downwardly facing control surface 52 and a lower upwardly facing control surface 54 of a slide 56 (displacement of the slide is restricted to vertical displacement by opposed vertical rails 57 partially shown) on a slide cover (not shown for clarity). The wheel gear has two "home" positions: one with the finger at 3:00 and the other with the finger at 9:00 and the wheel gear, as shown in FIG. 3, rotates counterclockwise. Assuming that the bolt is advanced with the finger at 3:00 and the slide at its fully down position as shown in FIG. 5, operation of the motor will rotate the wheel gear counterclockwise to bring the finger into engagement with the upper control surface 52. When the finger is at 12:00 it will engage the peak 53 location of the upper control surface and the slide will be at its fully up position. The motor will stop when the finger reaches 9:00 where the finger is proximate the lower control surface 54. When the motor is again operated, the finger will continue to move counterclockwise engaging the lower control surface 54 and setting the fully down position when it is at the peak 55 of this surface. Counterclockwise rotation will continue until the finger again reaches the 3:00 position proximate the upper control surface. To control the operation of the motor a plunger style micro switch 70 (FIG. 2) is secured to the support bracket to monitor the indexing of the wheel gear 39 and another similar switch 72 is secured to the support bracket to monitor whether the slide is within ⅛" of its fully up (unlocked) position. The first switch 70 is operated by a lever 74 which is mounted on the support bracket and which will be displaced by a pair of lever operators 76 secured to the rear of the wheel gear and displaced to operate the switch. When the motor is operated it will continue until one of the lever operators displaces the switch lever whereupon the motor will stop. The second switch 72 is operated by a ramp 73 (FIG. 5) at the top of the slide 56 which will displace the plunger of the second switch 72 if the slide is within ⅛" of its fully up position. If the second switch is operated, the control knows that the slide is at the up position.

Figure 6:
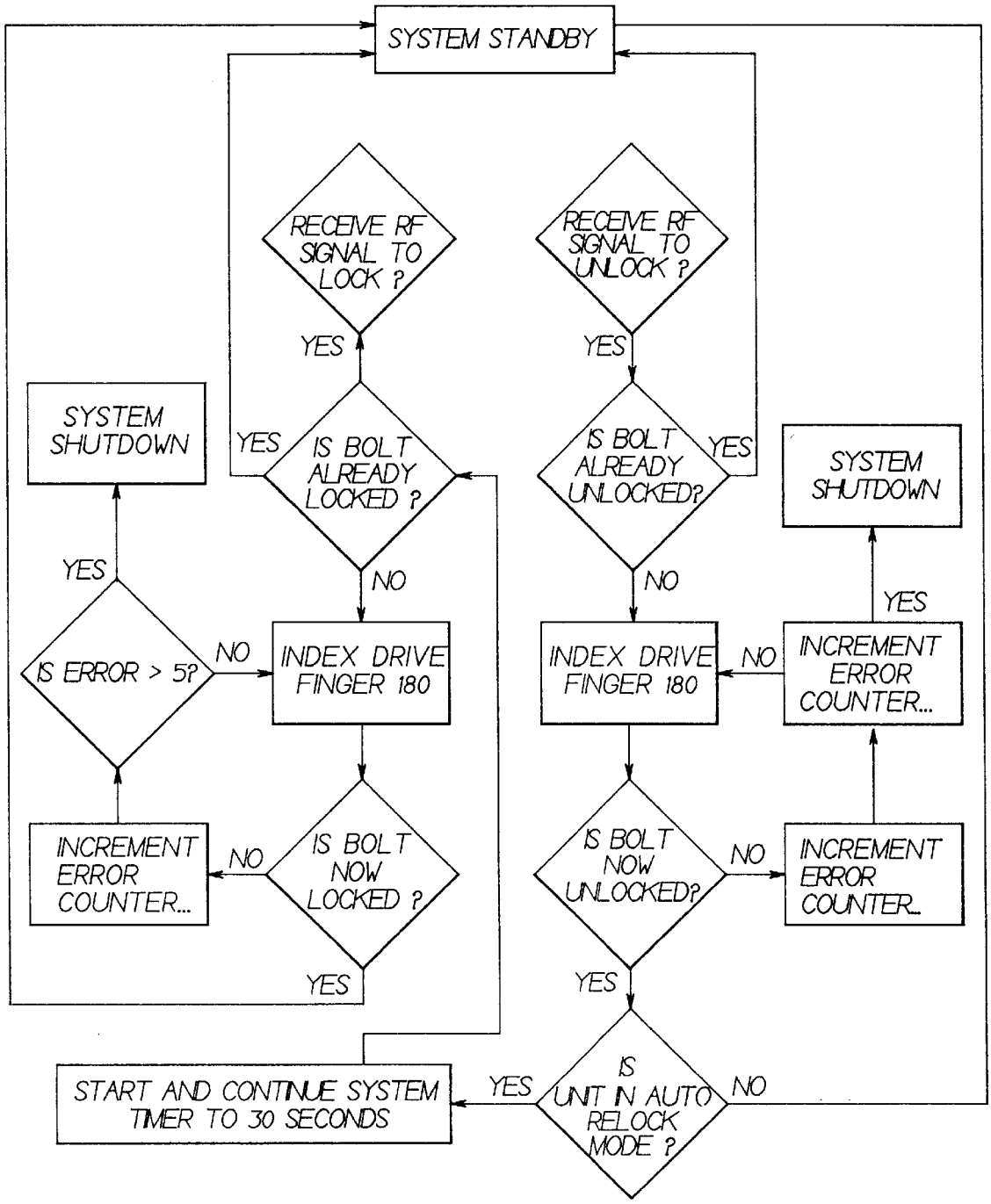
FIG. 6 is an electronic flow chart for the control of the electronic lock.

Referring to FIG. 5, a pinion 80 is mounted on the shaft portion 28 of the turn lever 10 and cooperates with a vertical rack 82 secured to the rear side of the slide. In the manual mode, rotation of either the key or the turn lever will rotate the torque blade 18 that is located within the "d" shaped opening 26 of the shaft portion 28 to displace the bolt either to the retracted position or to the advanced position. In this mode whenever the shaft portion is rotated (the shaft portion passes freely through the central hole 84 in the wheel gear), the pinion will rotate and the rack will be displaced vertically with no function. In the electronic unlock mode (FIG. 6), a transmitter 100 transmits an RF unlock signal which is received by a receiver (step 102) which will verify that the bolt is in fact extended whereupon (step 104). If the bolt is extended the motor will be operated to index the drive finger 180° (step 106—the wheel gear will be rotated counterclockwise 180° from its 3:00 slider fully down\deadbolt advanced position to its 9:00 slider fully up/deadbolt retracted position). This should unlock the bolt and if the control verifies that the bolt is at the unlocked position (step 108) the control determines whether or not the system is in the auto relock mode (step 110). In the event that the location of the bolt at the retracted position is not verified in step 108 an error counter will be incremented (step 112), the count (now 1) will be compared to 2 (step 114) and since the error count is less than 2, a second attempt will be made to retract the bolt (step 106). If the bolt again is not retracted the error counter will be incremented to 2 and since this count is now two, the comparator will send a signal (step 114) which will result in the issuance of an error signal. In the manual relock mode, the deadbolt will be manually relocked (while the manual relocking of the deadbolt lowers the slide to its lowest position, the finger does not move to its 9:00 position). When the control again receives an RF signal to unlock, it will know that the bolt has been advanced (step 104) and as a result the wheel gear will again be indexed 180° returning the finger to the 3:00 position. Since this will occur without retracting the bolt step 108 will result in the error counter being incremented (step 112) and the comparator (step 114) again operating the motor to index the drive finger a second 180° (step 106) back to the 9:00 position retracting the bolt.

In the alternative, the transmitter could also send a signal to lock the door. The receiver would receive the lock deadbolt signal (step 118) and then verify that the bolt was in the unlocked position (step 120) and then operate the motor to index the wheel gear the second 180° (step 122) to return the finger to the 3:00 position thereby advancing the deadbolt. The location of the advanced deadbolt is verified (step 124). If the bolt is not advanced an error counter is incremented (step 126) and a comparator again operates the motor (step 128) to make a second try at advancing the bolt. If the second try fails the error counter is incremented to 2 (step 126) and the comparator issues a signal (step 128) so that an error signal will be generated.

In the fully automatic mode, once the bolt is retracted and a decision is made that the unit is in the auto relock mode (step 110), a timer is operated (step 132) for a selected period of time and issues a signal to operate the motor to index the drive finger to lock the bolt (step 120).

A three position switch 90 can be switched to define operation in either an automatic relock mode or in a non-automatic mode or can be switched to a third teach mode so that transmitters can be introduced to the system.

As can be seen from FIG. 3, the finger has curved surfaces 92 and is supported on a deflectable element 94 so that if the finger ever is located at the 6:00 position with the door locked, manual turning of the turn lever will cam the finger out of the way so that the rack can elevate thereby permitting the pinion to rotate to open the door.

The lock may be installed for either left hand or right operation. Assuming that left hand operation is illustrated, right hand operation would result in movement by the finger in the clockwise direction. In this situation the other half of the upper and lower control surfaces would be engaged by the finger and the rack would be removed from the right side rack support 96 on the slide 56 and flipped over and placed in the left side rack support 98 on the slide. The slider has a pair of feet 99 and a head portion 100 which are contained within an upper rib 100 and two lower ribs 102 in the lower shroud.

Figure 7:
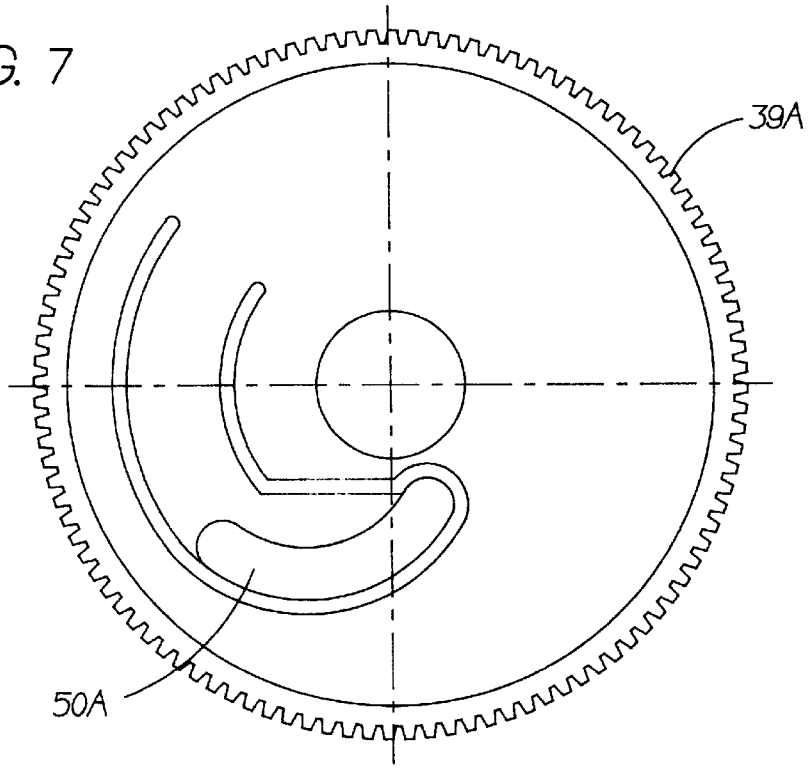
FIG. 7 is a view from the inside of an alternate wheel gear.
Figure 8:
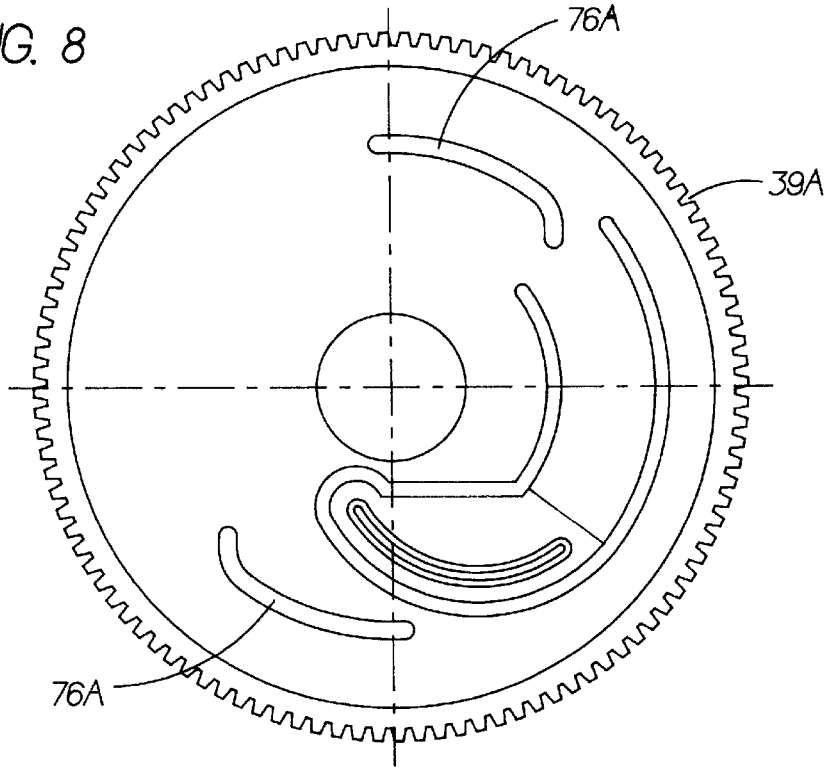
FIG. 8 is a view from the outside (front) of the alternate wheel gear shown in FIG. 7.
Figure 9:
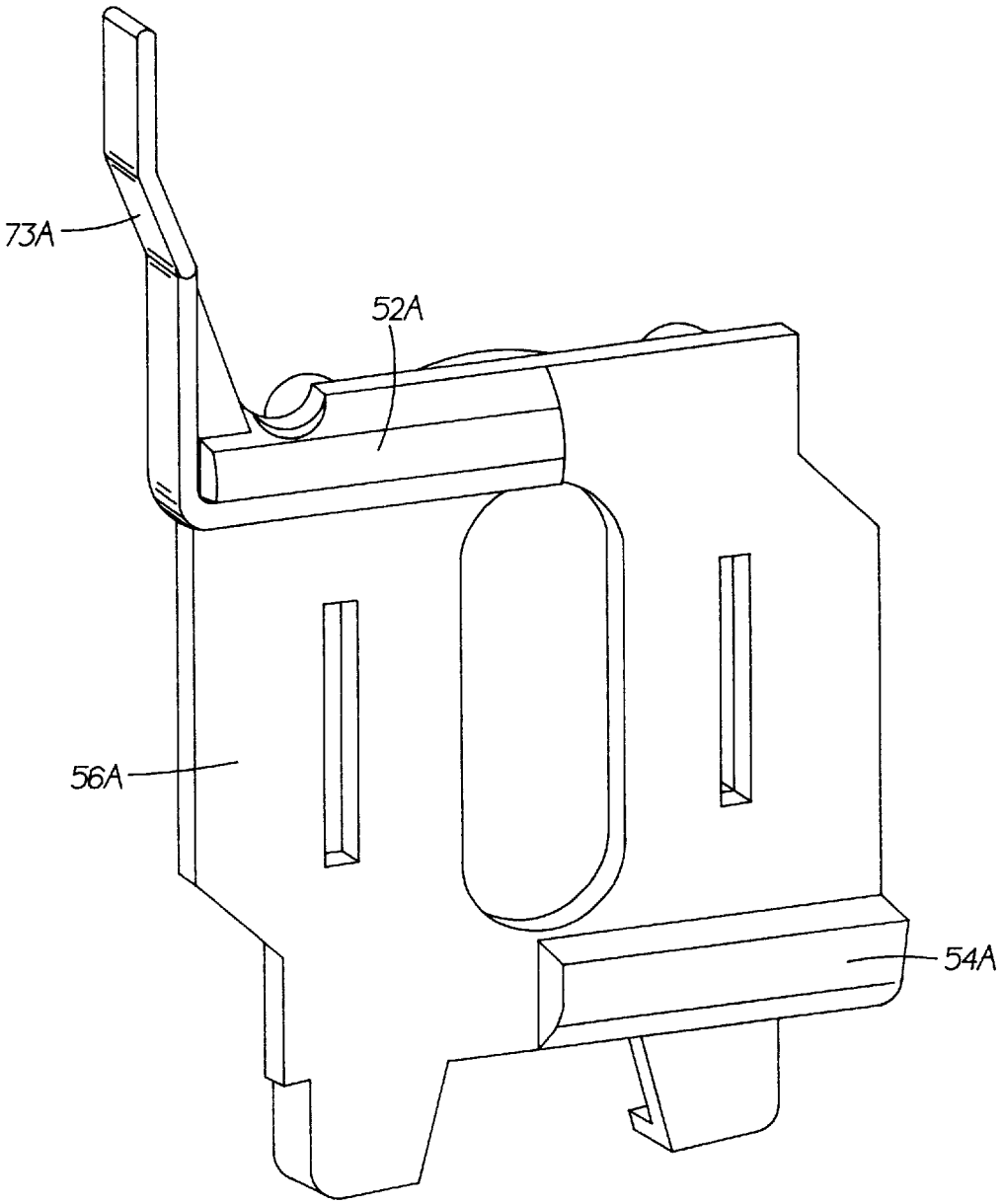
FIG. 9 is an oblique view, from the front of a rack portion of the interior turn lever assembly having an alternate embodiment to be used with the wheel gear shown in FIGS. 7 and 8.

The axially projecting finger 50 can be modified from a button as shown in FIG. 3 to a curved form similar to the configuration of a banana 50A as shown in FIG. 7 so that the moment arm of the finger engaging either the upwardly facing control surface 54A or the downwardly facing control surface 52A will be uniform throughout its engagement. In this embodiment the 3:00 position is the position where the curved finger is located in the 6:00 to 3:00 quadrant and the 9:00 position is the position where the curved finger is located in the 12:00 to 9:00 quadrant. The upwardly and downwardly facing control surfaces 52A,54A need only extend from the center of the slide 56A to the edge thereof. A pair of lever operators 76A will operate the switch 70 which monitors the indexing of the wheel gear 39A. In this alternate embodiment, the ramp 73A is designed to operate the second switch when the slide is within ⅛" of its fully down position (bolt advanced position).

I claim:

1. An electronically operated lock comprising a latch mechanism including a bolt and bolt actuation means having a rotatable actuator for displacing said bolt between advanced and retracted positions, rotatable spindle means for rotating said rotatable actuator, turn lever means for rotating said spindle means from the interior of a door to displace said bolt between said advanced and retracted positions, key operated plug means for rotating said spindle means from the exterior of the door to displace said bolt between said advanced and retracted positions, electronically operated means for rotating said spindle means to displace said bolt from said advanced position to said retracted position including a pinion secured to said spindle means, a slider supported for vertical displacement and having a vertical rack cooperating with said pinion, said slider having vertically separated upper and lower horizontally extending control surfaces, a rotatable wheel gear having an eccentric, axially projecting finger located intermediate said upper and lower horizontally extending control surfaces, a motor, gear means for connecting the output of said motor to said wheel gear, said upper and lower control surfaces being selectively located so that when said finger is rotated in one direction from a 3:00 position to a 9:00 position, said finger will displace said slider to displace said bolt to said retracted position and so that when said finger is rotated in said one direction from the 9:00 position to the 3:00 position, said finger will displace said slider to displace said bolt to said advanced position.

2. An electronically operated lock according to claim 1, wherein said wheel gear includes means for supporting said finger for axial deflection.

3. An electronically operated lock according to claim 2, wherein said finger is a button and has a rounded configuration to facilitate the deflection of said finger.

4. An electronically operated lock according to claim 2, wherein said finger is arcuate.

5. An electronically operated lock according to claim 1, further comprising first switch means for signaling that said finger is at either said 3:00 position or said 9:00 position.

6. An electronically operated lock according to claim 5, further comprising second switch means for signaling that said slide is substantially at either the bolt retracted or the bolt advanced position.

7. An electronically operated lock according to claim 1, further comprising a housing for said plug, and a torque blade rotatably supported by said housing, and said turn lever means includes a turn lever portion and a shaft portion interconnected with said torque blade, wherein said spindle means includes said torque blade and said interconnected shaft portion.

8. An electronically operated lock comprising a latch mechanism including a bolt and bolt actuation means having a rotatable actuator for displacing said bolt between advanced and retracted positions, rotatable spindle means for rotating said rotatable actuator, electronically operated means for rotating said spindle means to displace said bolt from said advanced position to said retracted position including a pinion secured to said spindle means, a slider supported for vertical displacement and having a vertical rack cooperating with said pinion, said slider having vertically separated upper and lower horizontally extending control surfaces, a rotatable wheel gear having an eccentric, axially projecting finger located intermediate said upper and lower horizontally extending control surfaces, a motor, gear means for connecting the output of said motor to said wheel gear, said upper and lower control surfaces being selectively located so that when said finger is rotated in one direction from a 3:00 position to a 9:00 position, said finger will displace said slider to displace said bolt to said retracted position and so that when said finger is rotated in said one direction from the 9:00 position to the 3:00 position, said finger will displace said slider to displace said bolt to said advanced position, first switch means for signaling that said finger is at said 3:00 or 9:00 position, and second switch means for signaling that said bolt is at said advanced position.

* * * * *